US005359340A

United States Patent [19]

Yokota

[11] Patent Number: 5,359,340

[45] Date of Patent: Oct. 25, 1994

[54] HELICAL ANTENNA FOR PORTABLE RADIO COMMUNICATION EQUIPMENT

[75] Inventor: Yasuhiro Yokota, Kawasaki, Japan

[73] Assignee: Fujitsu Limited, Kanagawa, Japan

[21] Appl. No.: 953,374

[22] Filed: Sep. 30, 1992

[51] Int. Cl.[5] ..... H01Q 11/08

[52] U.S. Cl. ..... 343/792; 343/895

[58] Field of Search ..... 343/895, 749, 702, 791, 343/792, 803, 806; H01Q 1/36, 11/08

[56] References Cited

U.S. PATENT DOCUMENTS

| | | | |
|---|---|---|---|
| 4,161,737 | 7/1979 | Albright | 343/749 |
| 4,270,128 | 5/1981 | Drewett | 343/895 |
| 5,061,942 | 10/1991 | Dorrie et al. | 343/749 |

OTHER PUBLICATIONS

"Dipoles and Monopoles", Chen To Tai, Antenna Engineering Handbook, 2nd Edition, Chapter 4, pp. 4-4--4-5.

"Helical Antennas", Howard E. King et al, Antenna Engineering Handbook, 2nd Edition, Chapter 13, pp. 13-2 to 13-19.

*Primary Examiner*—Michael C. Wimer

*Attorney, Agent, or Firm*—Nikaido, Marmelstein, Murray & Oram

[57] ABSTRACT

A small size helical antenna for radio communication equipment such as a portable transmitter/receiver, a pocket telephone, or a mobile telephone of small power type. The helical antenna is comprised of first and second parallel conductors wound in a coil shape. The second conductor is folded in parallel to the remaining part of the second conductor at some length in accordance with the transmitting/receiving frequency from the top end. The folded part and the upper part of the first conductor form a radiator of the dipole antenna structure and the parallel part of the first and the second conductors form a parallel feeder. The third conductor having the same length as the folded part may be provided on the lower part of the second conductor. According to the above-described structure, no return current flows from the helical antenna to the casing of the radio communication equipment on which the helical antenna is connected, thereby the directivity becomes maximum in a horizontal plane and an effect caused by holding the casing by a human hand is decreased.

34 Claims, 11 Drawing Sheets

HELICAL ANTENNA FOR PORTABLE RADIO COMMUNICATION EQUIPMENT

BACKGROUND OF THE INVENTION

1) Field of the Invention

The present invention relates to a helical antenna for portable radio communication equipment. More specifically, the present invention relates to a small helical antenna for a portable transmitter/receiver or a pocket telephone (mobile telephone) of a small power type used for an in-plant communication system or a tele-terminal.

2) Description of the Related Art

Recently, according to developments in radio communication equipment, a number of communication systems have adopted a radio communication system instead of using a wired system. As a result, there are no useable frequencies left in the low frequency band, so that gradually higher frequencies are being assigned for new radio communication systems, for example, frequency bands of 400 MHz to 800 MHz are assigned. It is now being planned to use a 1500 MHz band for a relational radio communication system as described above, as explained hereinafter.

In this way, as the frequency used for a radio communication system gets higher, the length of the antenna required gets shorter and the size gets smaller. However, as the size of the antenna gets smaller, it becomes more difficult to obtain a desirable antenna directivity.

Conventionally, a whip antenna that has a small-diameter and a vertical rod, and a helical antenna that has a coil shape and is mounted perpendicular to a flat metal-plate reflector, are used especially in mobile communications, portable radio and television receivers, field-strength meters, and the like. A dimensional relation between the whip antenna or the helical antenna and the casing thereof is different in accordance with the transmitting/receiving frequency required for the antenna. Usually, a casing of radio communication equipment having the whip or helical antenna is not designed in accordance with the optimum radiation therefrom but is designed in accordance with the performance and the output power of the equipment.

Accordingly, in the conventional antenna, as the transmitting/receiving frequency required for the antenna gets higher, the antenna does not provide the desired directivity. Further, in conventional radio communication equipment having an antenna, a return current from the antenna flows in the casing of the radio communication equipment, so the directivity of the antenna changes when the casing is held by a human hand.

SUMMARY OF THE INVENTION

An object of the present invention is to provide a helical antenna for a portable transmitter/receiver or a pocket telephone (mobile telephone) of a small power type used for an in-plant communication system or a tele-terminal, whose directivity can be maximum in a horizontal plane, and having little effect from a human body when the casing is held by a human hand.

According to an aspect of the present invention, there is provided a small size helical antenna for radio communication equipment such as a portable transmitter/-receiver, a pocket telephone, or a mobile telephone of a small power type, the helical antenna comprising: a first conductor being continuously wound helically from the top end to the bottom end that will be connected to a casing of the equipment; and a second conductor being wound in parallel over the helically wound first conductor with a predetermined spacing; wherein the second conductor has the same length as the first conductor, a predetermined length from the top end thereof is folded in parallel to the wound body of the second conductor to form a folded part, the unfolded part thereof is wound over the first conductor with its bottom end aligned with the bottom end of the first conductor to form a parallel feeder, and the folded part and the predetermined length from the top end of the first conductor comprise a radiator.

According to the helical antenna of the present invention, the folded part of the second conductor and the predetermined length from the top end of the first conductor comprise a radiator of a dipole antenna structure and transmitting and receiving is carried out by using this radiator. As a result, no return current flows from the helical antenna to the casing of the radio communication equipment on which the helical antenna is connected, so that the directivity becomes maximum in a horizontal plane and the effect caused by holding the casing with a human hand is decreased. Further, even if the casing is made of insulated resin, the return current does not flow to a radio communication circuit (printed circuit board) thereby preventing unstable operation of the circuit. Furthermore, since the first and the second conductors are wound in a coil shape, the height of the antenna becomes short, and a disturbance of the radiation pattern is small because the radiation part is apart from the casing held by a human hand.

Further, according to the existence of the third conductor whose free end is facing the free end of the folded part, an unbalanced current does not flow to the lower part from the folded point of the parallel feeder.

BRIEF DESCRIPTION OF THE DRAWINGS

The present invention will be more clearly understood from the description as set forth below, with reference to the accompanying drawings wherein.

DESCRIPTION OF THE PREFERRED EMBODIMENTS

Before describing the preferred embodiments, an explanation will be given of the conventional antenna, with reference to FIGS. 1 to 4C.

Figure 1:
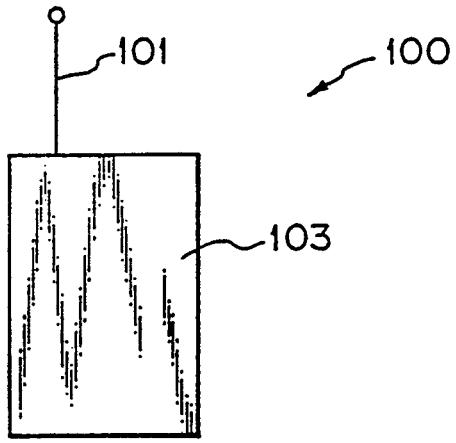
Fig. 1 PRIOR ART
FIG. 1 shows a front view of a portable radio communication equipment having a whip antenna.
Figure 2:
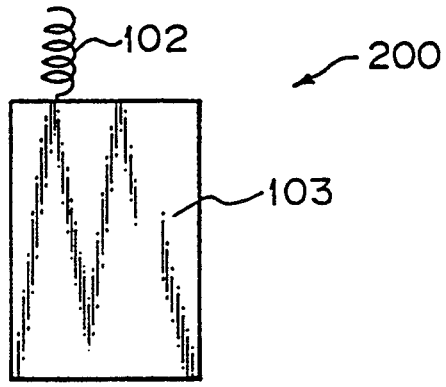
Fig. 2 PRIOR ART
FIG. 2 shows a front view of a portable radio communication equipment having a helical antenna.

FIG. 1 is a front view of a portable radio communication equipment 100 having a whip antenna 101 on the casing 103, and FIG. 2 is a front view of an other portable radio communication equipment 200 having a helical antenna 102 on the casing 103. The whip antenna 101 has a small-diameter and a vertical rod and the helical antenna 102 has a coil shape, both mounted perpendicular to the casing 103.

Figure 3A:
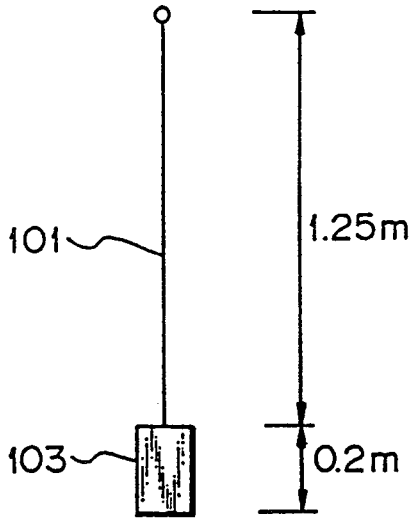
Fig. 3A PRIOR ART
FIG. 3A is an explanatory view showing a relation between the length of the whip antenna and the casing of the portable radio communication equipment at a transmitting/receiving frequency of 60 MHz.
Figure 3B:
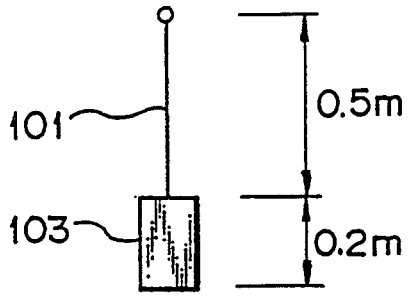
Fig. 3B PRIOR ART
FIG. 3B is an explanatory view showing a relation between the length of the whip antenna and the casing of the portable radio communication equipment at a transmitting/receiving frequency of 150 MHz.
Figure 3C:
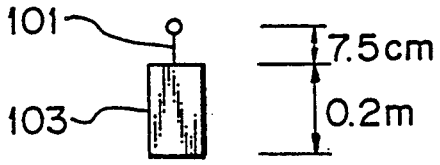
Fig. 3C PRIOR ART
FIG. 3C is an explanatory view showing a relation between the length of the whip antenna and the casing of the portable radio communication equipment at a transmitting/receiving frequency of 800 MHz.

A dimensional relation between the whip antenna 101 and the casing 103 is different in accordance with the transmitting/receiving frequency required for the whip antenna 101 as shown in FIG. 3A to 3C. The whip antenna 101 in FIG. 3A having a height of 1.25 m is suitable for transmitting/receiving a frequency of 60 MHz, the whip antenna 101 in FIG. 3B having a height of 0.5 m is suitable for transmitting/receiving a frequency of 150 MHz, and the whip antenna 101 in FIG. 3C having a height of 7.5 cm is suitable for transmitting/receiving a frequency of 800 MHz, although the height of the casing 103 is always 0.2 m. As shown in FIGS. 3A to 3C, the casing 103 of the radio communication equipment having the whip antenna 101 is not designed in accordance with the optimum radiation therefrom but is designed in accordance with the performance and the output power of the equipment.

Figure 4A:
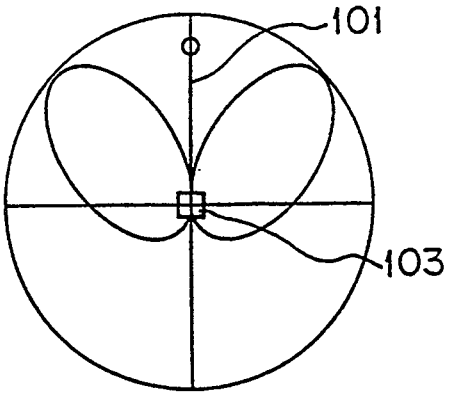
Fig. 4A PRIOR ART
FIG. 4A is a directional characteristic pattern in a vertical plane of a whip antenna shown in FIG. 3A.
Figure 4B:
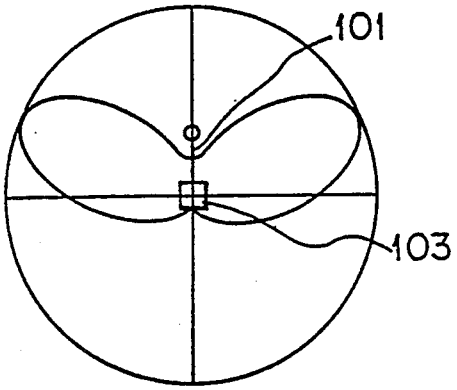
Fig. 4B PRIOR ART
FIG. 4B is a directional characteristic pattern in a vertical plane of a whip antenna shown in FIG. 3B.
Figure 4C:
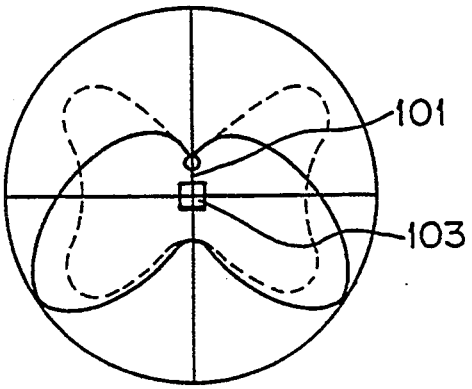
Fig. 4C PRIOR ART
FIG. 4C is a directional characteristic pattern in a vertical plane of a whip antenna shown in FIG. 3C.

However, in the prior art, when the transmitting/receiving frequency required for the whip antenna gets higher, the directivity of the whip antenna does not agree with the desired directivity as shown in FIGS. 4A to 4C. FIG. 4A is a directional characteristic pattern in a vertical plane of the whip antenna 101 shown in FIG. 3A (60 MHz), FIG. 4B is the same pattern of the whip antenna 101 shown in FIG. 3B (150 MHz), and FIG. 4C is the same pattern of the whip antenna 101 shown in FIG. 3C (800 MHz).

Further, in the conventional radio communication equipment having the whip antenna 101, a return current from the antenna 101 flows in the casing 103 of the radio communication equipment, so that the directivity of the antenna changes when the manner of holding the casing 103 by a human hand is changed. The dash line in FIG. 4C is the directional characteristic pattern in a vertical plane of the whip antenna 101 when the manner of holding the casing 103 by a human hand is changed.

These defects also exist in radio communication equipment having the helical antenna. Accordingly, in the prior art, the problem of directivity of the antenna for portable radio communication equipments still exists.

Figure 5A:
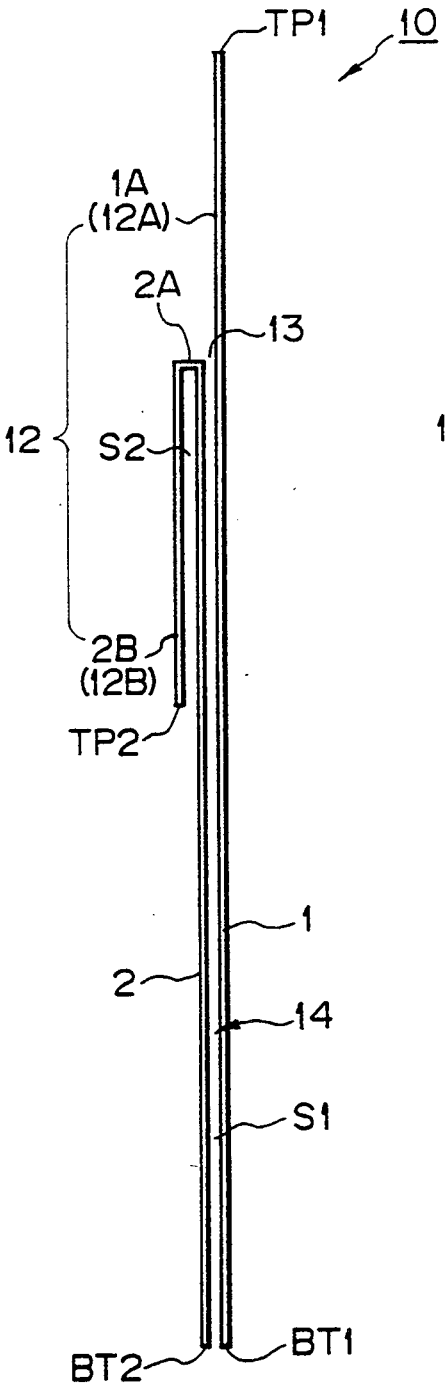
FIG. 5A is a side view of a helical antenna before winding/showing a structure thereof according to the first embodiment of the present invention.
Figure 5B:
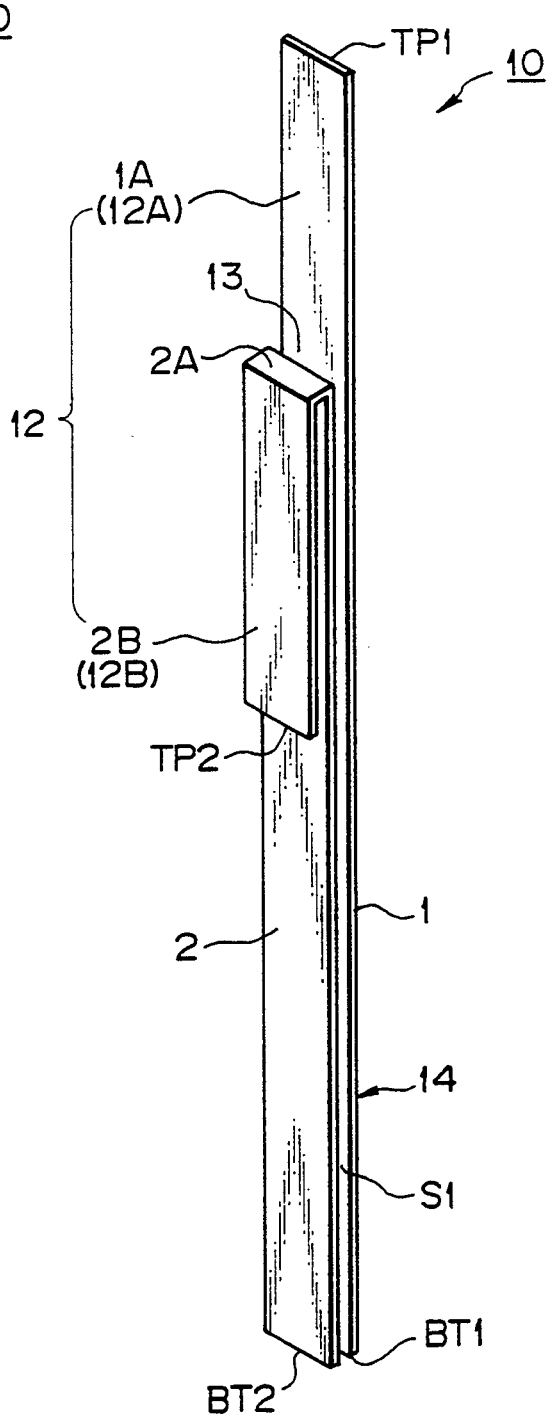
FIG. 5B is a perspective side view of the helical antenna shown in FIG. 5A.

FIG. 5A is a side view of a helical antenna 10 before being wound helically, showing a structure thereof according to the first embodiment of the present invention, and FIG. 5B is a perspective side view of the helical antenna 10 shown in FIG. 5A.

In FIGS. 5A and 5B, reference numeral 1 denotes a first conductor, 1A denotes an upper part of the first conductor, 2 denotes a second conductor, 2A denotes a folding point, 2B denotes a folded part of the second conductor, 12 denotes a radiator of a dipole structure made of the upper part 1A and the folded part 2B, 13 denotes a joining point of the radiator 12, 14 denotes a parallel feeder, BT1 and BT2 denote a bottom end of the first and the second conductor 1 and 2, S1 denotes a space between the first and the second conductors 1 and 2, S2 denotes a space between the second conductor 2 and the folded part 2B, and TP1 and TP2 denote a top end of the first and the second conductors 1 and 2.

As shown in FIG. 5B, the conductor 1 and 2 are both flat band plates having the same width, height, and thickness. A predetermined length of the second conductor 2 from the top end TP2 is folded at the folding point 2A in parallel to the rest of the second conductor 2 with a space S2 to form a folded part 2B. The length of the folded part 2B is determined in accordance with the transmitting/receiving frequency required for the helical antenna. Then the second conductor 2 is piled on the first conductor 1 with its bottom end BT2 accorded to the bottom end BT1 of first conductor 1. When the second conductor 2 is wound on the first conductor 1, the upper part 1A of the first conductor 1 having the predetermined length from the top end TP1 forms an upper radiation part 12A, and the folded part 2B of the second conductor 2 forms a folded radiation part 12B, thereby forming the radiator 12 of a dipole antenna structure. The rest of the first and the second conductor 1 and 2 form in parallel a feeder 14.

Figure 6:
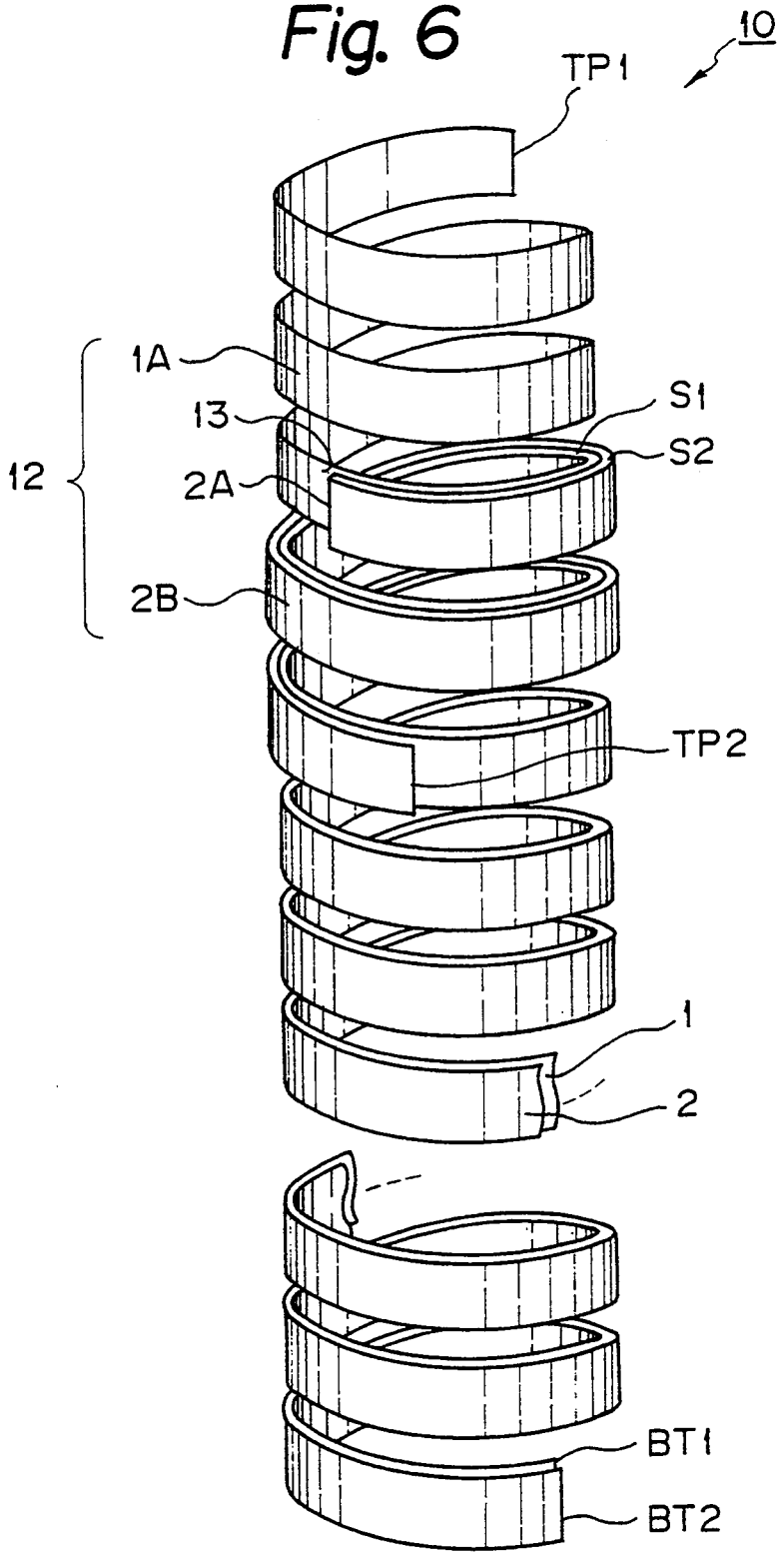
FIG. 6 is a perspective side view of the helical antenna according to the first embodiment of the present invention shown in FIGS. 5A and 5B.

The first and the second conductors 1 and 2 are wound helically from the bottom end BT1 and BT2 by using a jig of some type to form the helical antenna 1 of the first embodiment of the present invention as shown in FIG. 6. FIG. 6 is a perspective side view of the helical antenna 1 according to the first embodiment of the present invention after the first and the second conductor 1 and 2 are wound helically. Note that the thickness of the first and the second conductors 1 and 2 is not shown in FIG. 6.

Figure 7A:
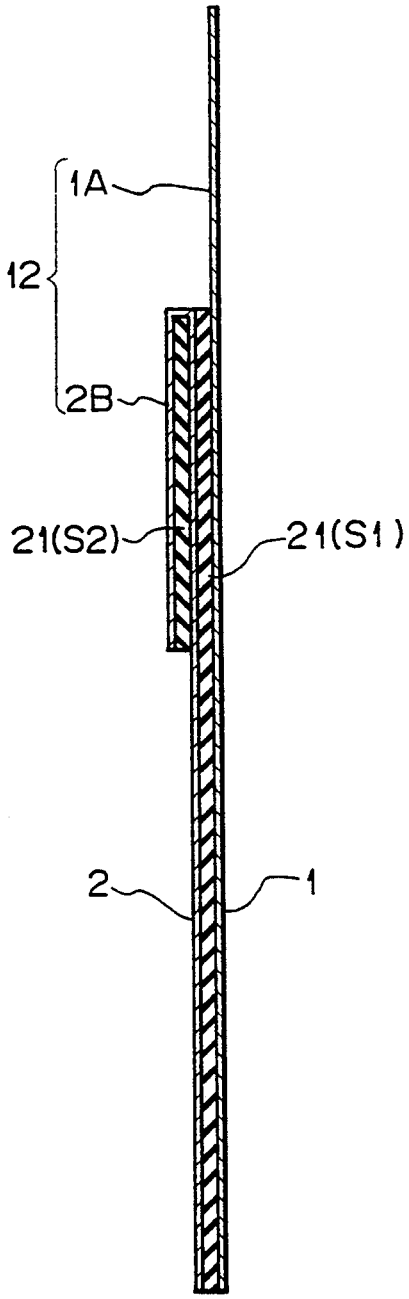
FIG. 7A is a side view of a helical antenna before winding showing a first actual structure thereof including an insulation between a parallel part of a metal feeder according to one embodiment of the present invention.
Figure 7B:
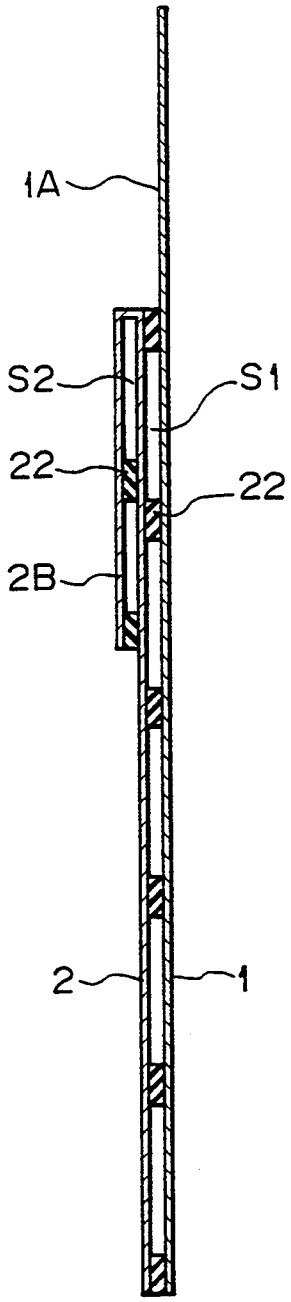
FIG. 7B is a side view of a helical antenna before winding showing a second actual structure thereof including an insulation between a parallel part of a metal feeder according to one embodiment of the present invention.
Figure 7C:
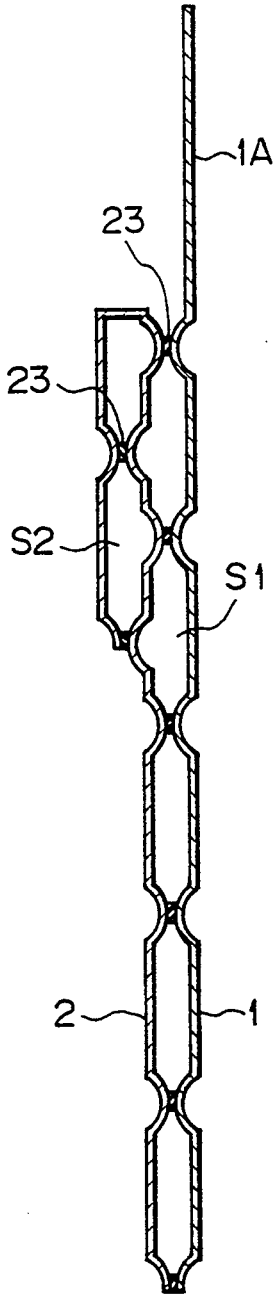
FIG. 7 is a side view of a helical antenna before winding showing a third actual structure thereof including an insulation between a parallel part of a metal feeder according to one embodiment of the present invention.

In the present invention, the space S1 between the first and the second conductor 1 and 2, and the space S2 between the second conductor 2 and the folded part 2B, are necessary to prevent the conductors from contacting each other. Accordingly, the space S1 and the space S2 must be guaranteed by using the spacing material. FIGS. 7A to 7C show some examples of the spacing material. FIG. 7A is a side view of a helical antenna 10 before winding showing a first actual structure of the spacing material. In FIG. 7A, the space S1 and the space S2 are fully filled with an insulating material 21. FIG. 7B is a side view of a helical antenna 10 before winding showing a second actual structure of the spacing material. In FIG. 7B, the space S1 and the space S2 are partly filled with an insulating material 22. FIG. 7C is a side view of a helical antenna 20 before winding showing a third actual structure of the spacing material. In FIG. 7C, a predetermined facing part at the same position of the first and the second conductors 1 and 2, and the second conductor 2 and the folded part 2B are curved to contact each other and the contact point is insulated by an insulating material 23 to prevent the contact of the conductors.

Figure 8:
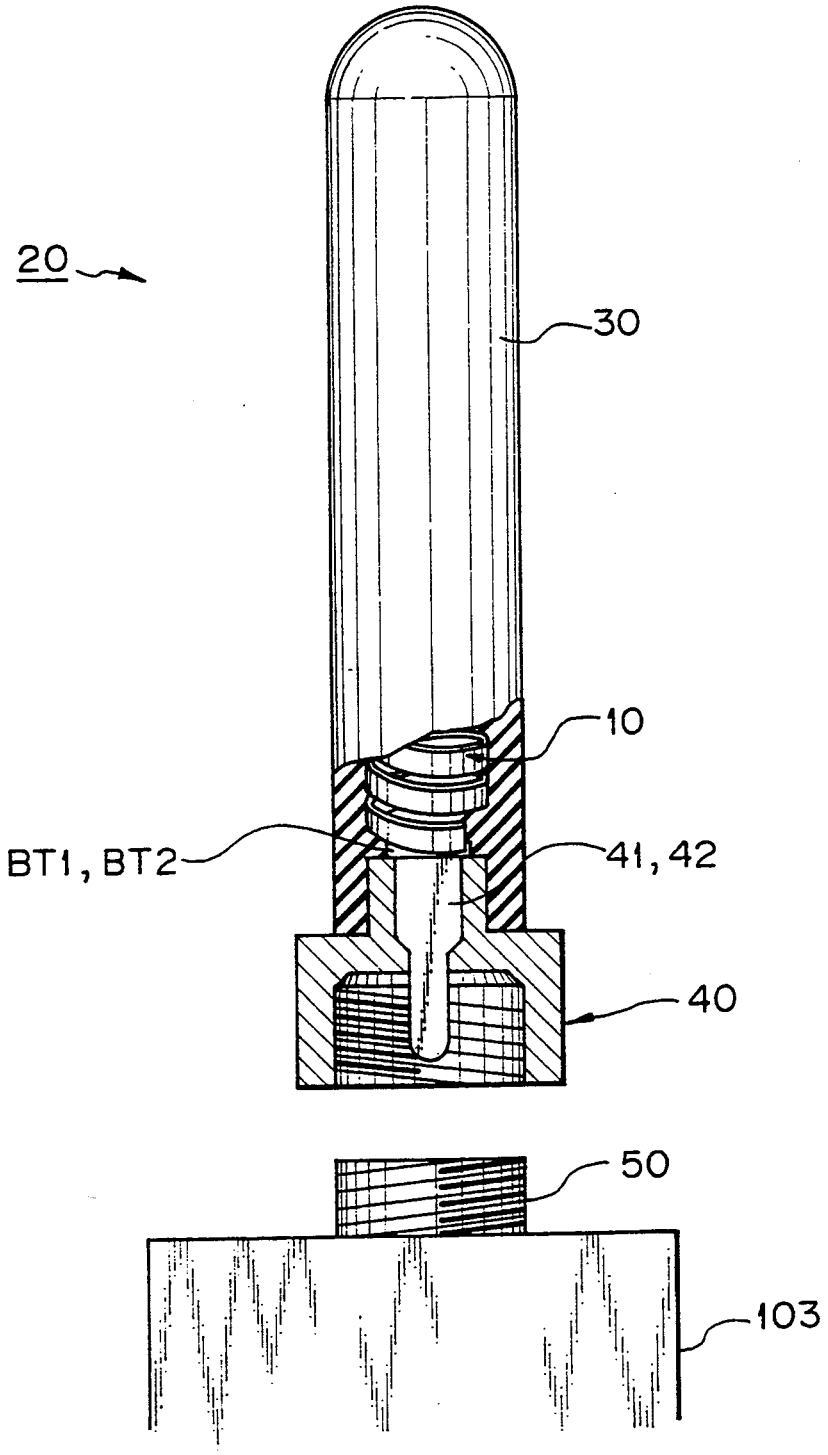
FIG. 8 is a side view in partial cross section of the helical antenna connected to a female connector and covered with a rubber protector, and an upper part of the portable radio communication equipment having a male connector.

When the helical antenna 10 as shown in FIG. 6 is formed, the helical antenna 10 is entirely covered with rubber protector 30 and the bottom ends BT1 and BT2 thereof are electrically connected to the terminals 41 and 42 of the connector 40 respectively as shown in FIG. 8, and a helical antenna 20 for portable radio communication equipment is produced. The connector 40 of this embodiment is a female connector having an inner screw thread, and is screwed on to the male connector 50 provided on the casing 103 of the radio communication equipment.

According to the above-described structure of the helical antenna 10 of the present invention, since the upper radiation part 12A and the folded radiation part 12B form the radiator 12 of the dipole antenna structure, no return current flows from the helical antenna 10 to the casing 103 of the radio communication equipment, thereby the directivity becomes maximum in a horizontal plane and the effect of holding the casing 103 by a human hand is decreased. Further, even if the casing 103 is made of insulated resin, no return current flows to a radio communication circuit (printed circuit board) thereby preventing an unstable operation of the circuit. Furthermore, since the first and the second conductors 1 and 2 are wound in a coil shape, the height of the antenna 10 becomes short, and a disturbance of the radiation pattern is reduced because the radiator 12 is apart from the casing 103 held by a human hand.

Figure 9:
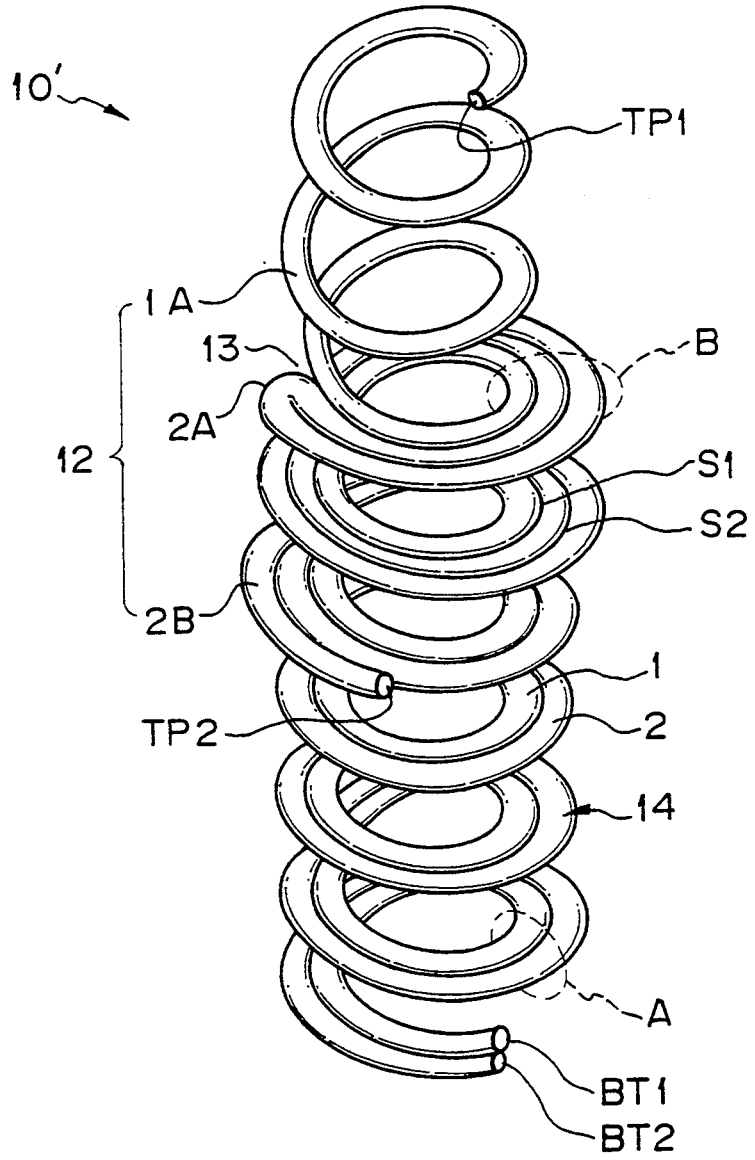
FIG. 9 is a perspective side view of the helical antenna according to the second embodiment of the present invention.

FIG. 9 is a perspective side view of the helical antenna 10′ according to the second embodiment of the present invention. In this embodiment, the structure of the helical antenna 10′ is the same as the helical antenna 10 of the first embodiment as shown in FIG. 5A, except that the first conductor 1 and the second conductor 2 are not flat band plates but are filament shaped. Accordingly, in FIG. 9, the same parts as used in FIG. 6 are assigned the same reference numerals and the explanation thereof is omitted.

Figure 10A:
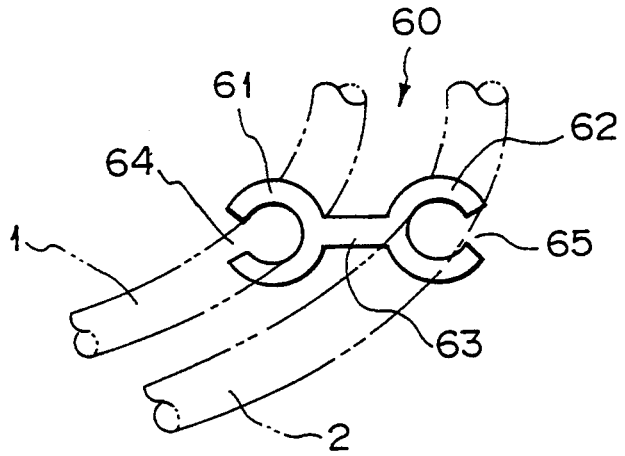
FIG. 10A is an enlarged explanatory view showing a spacer used at part A in FIG. 9.
Figure 10B:
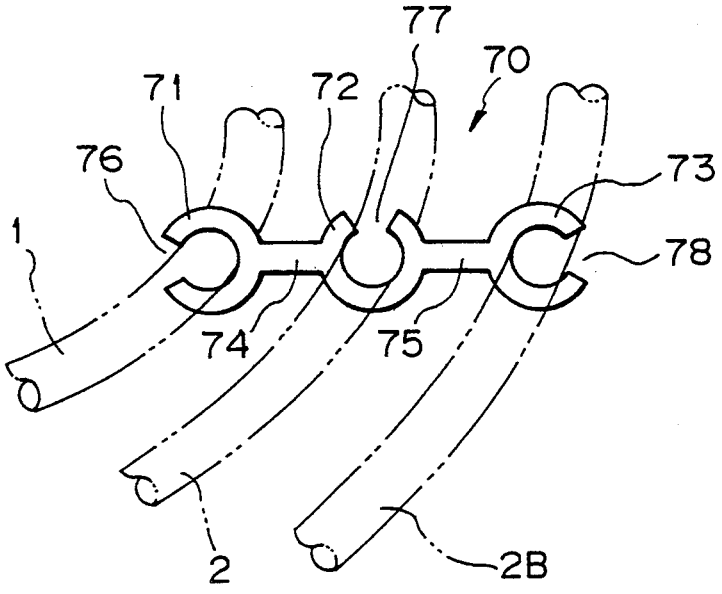
FIG. 10B is an enlarged explanatory view showing a spacer used at part B in FIG. 9.

In the second embodiment, since the first conductor 1 and the second conductor 2 are filament shaped, the space S1 between the first and the second conductors 1 and 2, and the space S2 between the second conductor 2 and the folded part 2B, are guaranteed by using spacing members as shown in FIGS. 10A and 10B. FIG. 10A is an enlarged view showing a spacer 60 used at dotted part A in FIG. 9, and FIG. 10B is an enlarged view showing a spacer 70 used at a dotted part B in FIG. 9.

The spacer 60 consists of two C-shaped rings 61 and 62 having openings 64 and 65 respectively, and a connecting bar 63 for connecting the rings 61 and 62. The spacer 60 is made of insulation material and the first and the second conductors 1 and 2 are inserted into the rings 61 and 62 through openings 64 and 65 respectively. The spacer 70 consists of three C-shaped rings 71, 72, and 73 having openings 76, 77, and 78 respectively, a connecting bar 74 for connecting the rings 71 and 72, and a connecting bar 75 for connecting the rings 72 and 73. The spacer 70 is made of insulation material and the first and the second conductors 1 and 2, and the folded part 2B are inserted to the rings 71 to 73 through openings 66 to 78 respectively. These spacers 60 and 70 are provided at predetermined intervals.

Figure 11:
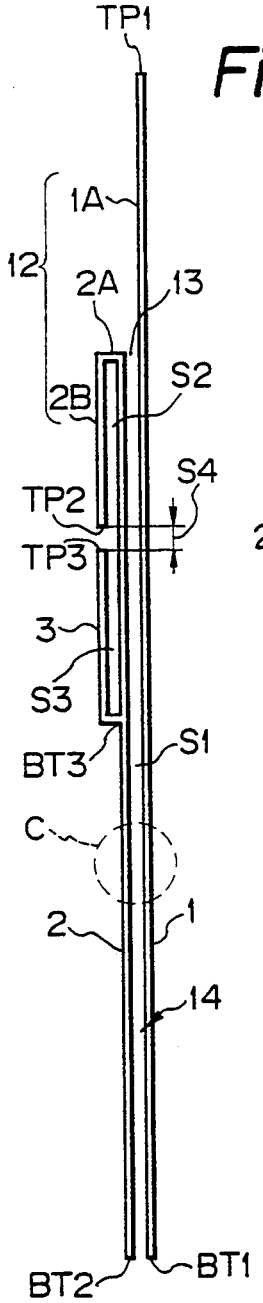
FIG. 11 is a side view of a helical antenna before winding showing a structure thereof according to the third embodiment of the present invention.

FIG. 11 is a side view of a helical antenna 10″ before winding showing a structure thereof according to the third embodiment of the present invention. In this embodiment, the basic structure of the helical antenna 10″ is the same as the helical antenna 10 of the first embodiment as shown in FIG. 5A, except the third conductor 3 is added. Accordingly, in FIG. 11, the same parts as used in FIG. 5A are assigned of the same reference numerals and an explanation thereof is omitted.

The third conductor 3 has the same length as the folded part 2B and is wound in parallel on the second conductor 2 with a predetermined space S3 with a free end TP3 facing the free end TP2 of the folded part 2B with a space S4 therebetween and the bottom end BT3 is electrically connected to the second conductor 2.

Figure 12:
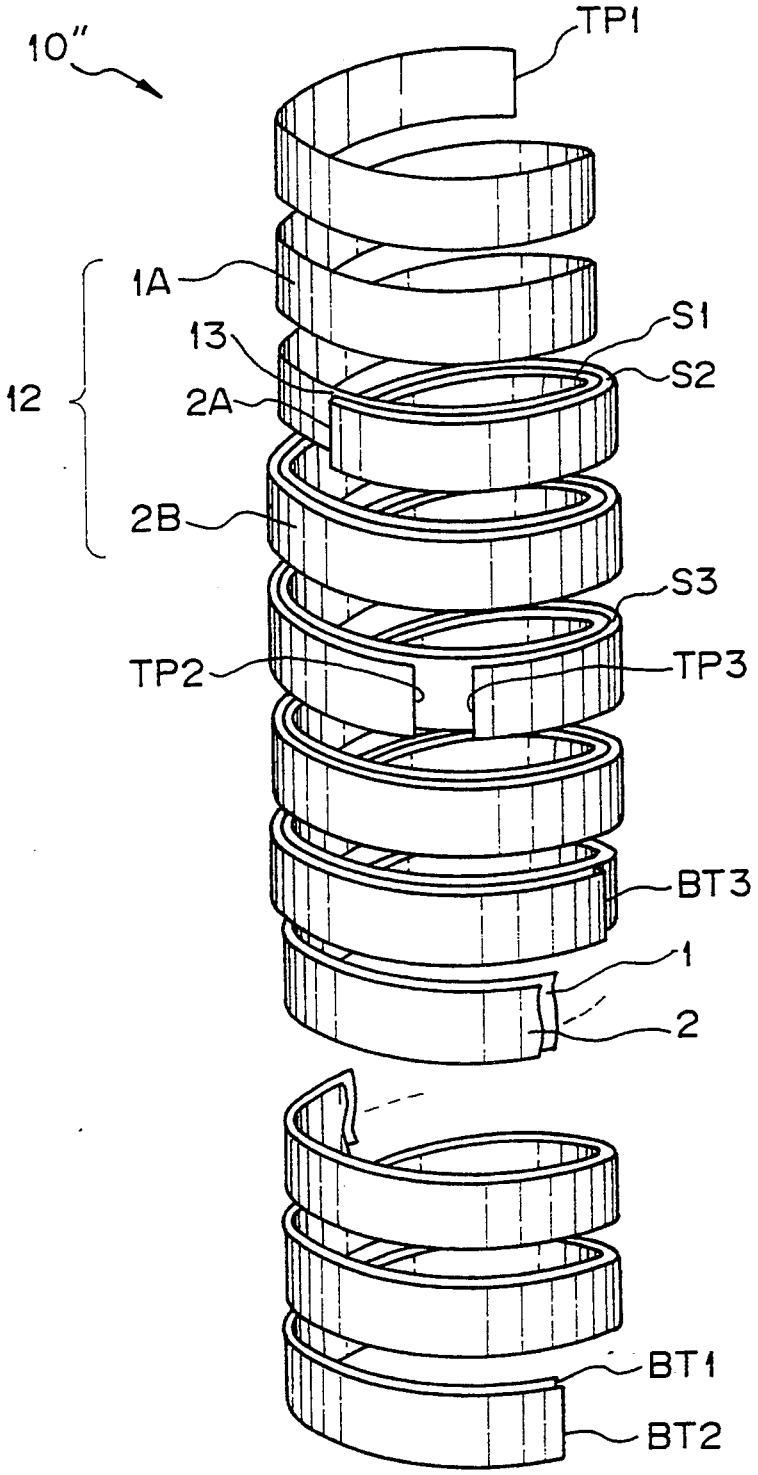
FIG. 12 is a perspective side view of the helical antenna according to the third embodiment of the present invention shown in FIG. 11.

Then the first, the second, and the third conductors 1 to 3 are wound helically from the bottom end BT1 and BT2 by using a jig of some type to form the helical antenna 10″ of the third embodiment of the present invention. FIG. 12 is a perspective side view of the helical antenna 10″ according to the third embodiment of the present invention when the conductors 1 to 3 are all flat band plates having the same width and thickness. Note that the thickness of the first to the third conductors 1 to 3 are not shown in the FIG. 12 embodiment.

Due to the existence of the third conductor 3, unbalanced current does not flow to the lower part of the parallel feeder 14.

Figure 13A:
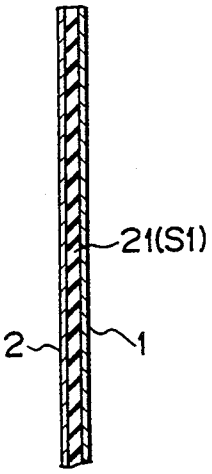
FIG. 13A is a side view of part C of the helical antenna in FIG. 11 showing an embodiment of the first actual insulation structure.
Figure 13B:
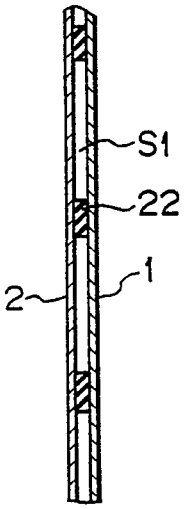
FIG. 13B is a side view of part C of the helical antenna in FIG. 11 showing an embodiment of the second actual insulation structure.
Figure 13C:
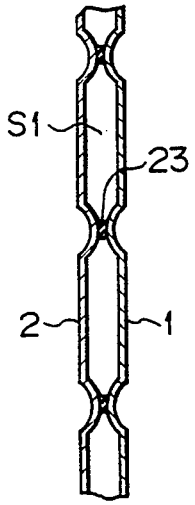
FIG. 13C is a side view of part C of the helical antenna in FIG. 11 showing an embodiment of the third actual insulation structure.

The spaces S1, S2, and S3 are guaranteed by using the spacing material in the same manner as explained hereinbefore. FIGS. 13A to 13C are enlarged views of parts C in FIG. 11 showing the same examples of the spacing material as explained for FIGS. 7A to 7C. FIG. 13A shows the first actual structure of the spacing material, wherein the spaces S1 to S3 are fully filled with an insulating material 21. FIG. 13B shows the second actual structure of the spacing material, wherein the spaces S1 to S3 are partly filled with the insulating material 22. FIG. 13C shows the third actual structure of the spacing material wherein the predetermined facing part at the same position of the conductors 1 to 2 are curved to contact each other and the contact point is insulated by an insulating material 23 to prevent the contact of the conductors.

The conductors 1, 2, and 3 in FIG. 11 are explained as flat band plates, but these conductors 1, 2, and 3 can also be filament shaped.

What is claimed is:

1. A small size helical antenna for radio communication equipment including at least one of a portable transmitter/receiver, a pocket telephone, and a small power type mobile telephone, said helical antenna comprising:

a first conductor being continuously wound helically from a top end to a bottom end, said first conductor connected to a casing of said equipment; and a second conductor being helically wound together in parallel with said helically wound first conductor with a predetermined space between facing surfaces thereof;

wherein said second conductor having a same length as said first conductor, a predetermined length from a top end of said second conductor is folded in parallel to a remaining portion of said second conductor to form a folded part with said predetermined space between facing surfaces thereof, an unfolded part thereof is helically wound in parallel together with said first conductor with a bottom end of said second conductor aligned with said bottom end of said first conductor to form a parallel feeder, and said folded part of said second conductor and a predetermined length from said top end of said first conductor comprise a radiator.

2. A helical antenna as set forth in claim 1, wherein said first and second conductors are both flat band plates.

3. A helical antenna as set forth in claim 2, wherein said helical antenna is entirely covered with a rubber protector.

4. A helical antenna as set forth in claim 2, wherein said predetermined spaces between said first and second conductors, and said second conductor and said folded part are fully filled with an insulating material.

5. A helical antenna as set forth in claim 4, wherein said helical antenna is entirely covered with a rubber protector.

6. A helical antenna as set forth in claim 2, wherein said predetermined spaces between said first and second conductors, and said second conductor and said folded part are 7. A helical antenna as set forth in claim 6, wherein said helical antenna is entirely covered with a rubber protector.

8. A helical antenna as set forth in claim 2, wherein the facing surfaces of said first and second conductors, and said second conductor and said folded part include a plurality of protrusions at same positions to extend toward each other and each farthest extending point of the protrusion is insulated by an insulating material to prevent contact of said conductors.

9. A helical antenna as set forth in claim 8, wherein said helical antenna is entirely covered with a rubber protector.

10. A helical antenna as set forth in claim 1, wherein said first and second conductors are both shaped like a filament.

11. A helical antenna as set forth in claim 10, wherein said helical antenna is entirely covered with a rubber protector.

12. A helical antenna as set forth in claim 10, wherein said predetermined spaces between said first and second conductors, and said second conductor and said folded part are fully filled with an insulating material.

13. A helical antenna as set forth in claim 12, wherein said helical antenna is entirely covered with a rubber protector.

14. A helical antenna as set forth in claim 10, wherein said predetermined spaces between said first and second conductors, and said second conductor and said folded part are partly filled with an insulating material to prevent the contact of said conductors.

15. A helical antenna as set forth in claim 14, wherein said helical antenna is entirely covered with a rubber protector.

16. A helical antenna as set forth in claim 10, wherein the facing surfaces of said first and second conductors, and said second conductor and said folded part include a plurality of protrusions at same positions to extend toward each other and each furthest extending point of the protrusion is insulated by an insulating material to prevent contact of said conductors.

17. A helical antenna as set forth in claim 16, wherein said helical antenna is entirely covered with a rubber protector.

18. A helical antenna as set forth in claim 1, further comprising a third conductor having a same length as said folded part and being wound in parallel with said helically wound second conductor with said predetermined space therebetween and with a free end facing with the free end of said folded part with some space therebetween and the other end being electrically connected to said second conductor.

19. A helical antenna as set forth in claim 18, wherein said first an second conductors are both flat band plates.

20. A helical antenna as set forth in claim 19, wherein said helical antenna is entirely covered with a rubber protector.

21. A helical antenna as set forth in claim 19, wherein said predetermined spaces between said first and second conductors, said second conductor and said folded part, and said second conductor and said third conductor are fully filled with an insulating material.

22. A helical antenna as set forth in claim 21, wherein said helical antenna is entirely covered with a rubber protector.

23. A helical antenna as set forth in claim 19, wherein said predetermined spaces between said first and second conductors, said second conductor and said folded part, and said second conductor and said third conductor are partly filled with an insulating material to prevent the contact of said conductors.

24. A helical antenna as set forth in claim 23, wherein said helical antenna is entirely covered with a rubber protector.

25. A helical antenna as set forth in claim 19, wherein the facing surfaces of said first and second conductors, said second conductor and said folded part, and said second conductor and said third conductor include a plurality of protrusions at same positions to extend toward each other and each furthest extending point of the protrusion is insulated by an insulating material to prevent contact of said conductors.

26. A helical antenna as set forth in claim 25, wherein said helical antenna is entirely covered with a rubber protector.

27. A helical antenna as set forth in claim 18, wherein said first and second conductors are both shaped like a filament.

28. A helical antenna as set forth in claim 27, wherein said helical antenna is entirely covered with a rubber protector.

29. A helical antenna as set forth in claim 27, wherein said predetermined spaces between said first and second conductors, said second conductor and said folded part, and said second conductor and said folded part, and said second conductor and said third conductor are fully filled with an insulating material.

30. A helical antenna as set forth in claim 29, wherein said helical antenna is entirely covered with a rubber protector.

31. A helical antenna as set forth in claim 27, wherein said predetermined spaces between said first and second conductors, said second conductor and said folded part, and said second conductor and said third conductor are partly filled with an insulating material to prevent the contact of said conductors.

32. A helical antenna as set forth in claim 31, wherein said helical antenna is entirely covered with a rubber protector.

33. A helical antenna as set forth in claim 27, wherein the facing surfaces of said first and second conductors, said second conductor and said folded part, and said second conductor and said third conductor including a plurality of protrusions at same positions to extend toward each other and each furthest extending point of the protrusion is insulated by an insulating material to prevent contact of said conductors.

34. A helical antenna as set forth in claim 33, wherein said helical antenna is entirely covered with a rubber protector.

* * * * *